US008720067B2

(12) United States Patent
Gil

(10) Patent No.: US 8,720,067 B2
(45) Date of Patent: May 13, 2014

(54) CONTOURED ROLLER SYSTEM AND ASSOCIATED METHODS AND RESULTING ARTICLES OF MANUFACTURE

(75) Inventor: Christopher M. Gil, Kent, WA (US)

(73) Assignee: Blue Origin, LLC, Kent, WA (US)

( * ) Notice: Subject to any disclaimer, the term of this patent is extended or adjusted under 35 U.S.C. 154(b) by 492 days.

(21) Appl. No.: 12/941,955

(22) Filed: Nov. 8, 2010

(65) Prior Publication Data

US 2011/0107808 A1 May 12, 2011

Related U.S. Application Data

(60) Provisional application No. 61/259,068, filed on Nov. 6, 2009.

(51) Int. Cl.
*B21D 47/00* (2006.01)

(52) U.S. Cl.
USPC ..... 29/897.3; 29/897; 72/49; 72/28.2; 72/31.1; 72/215; 72/224; 72/226; 72/365.2; 72/366.2; 72/379.2; 164/476

(58) Field of Classification Search
USPC ..... 29/897, 897.3–897.34, 33 D; 72/49, 72/28.2, 31.1, 99, 214, 215, 224, 225, 226, 72/365.2, 366.2, 379.2; 164/465, 476
See application file for complete search history.

(56) References Cited

U.S. PATENT DOCUMENTS

| | | | | |
|---|---|---|---|---|
| 18,058 | A | 8/1857 | Raymond | |
| 2,969,826 | A | 3/1956 | Allen et al. | |
| 3,491,569 | A | 1/1970 | Sabirov | |
| 4,569,386 | A * | 2/1986 | Mine | 164/476 |
| 5,575,402 | A | 11/1996 | Botsolas | |

OTHER PUBLICATIONS

International Search Report and Written Opinion, International Application No. PCT/US2010/055884, Applicant: Blue Origin, LLC., mailed Jan. 10, 2011, 12 pages.

* cited by examiner

*Primary Examiner* — Richard Chang
(74) *Attorney, Agent, or Firm* — Perkins Coie LLP

(57) ABSTRACT

A contoured roller set and associated systems and methods are disclosed herein. A male roller having a convex surface and a pair of female rollers each having a concave surface can receive a generally thin sheet of material and impart a doubly-curved shape to the sheet. The convex and concave surfaces of the male and female rollers can have a radius of curvature chosen to match a radius of curvature of the sheet of material. The rollers are positioned and shaped to urge the sheet between the female rollers to cause the sheet to curve toward the male roller.

10 Claims, 9 Drawing Sheets

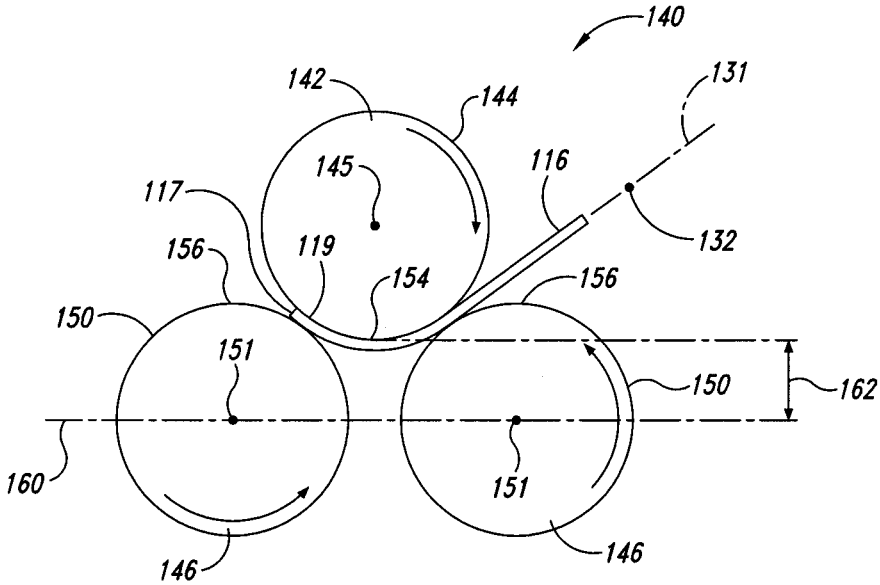
Fig. 6C
Fig. 6D
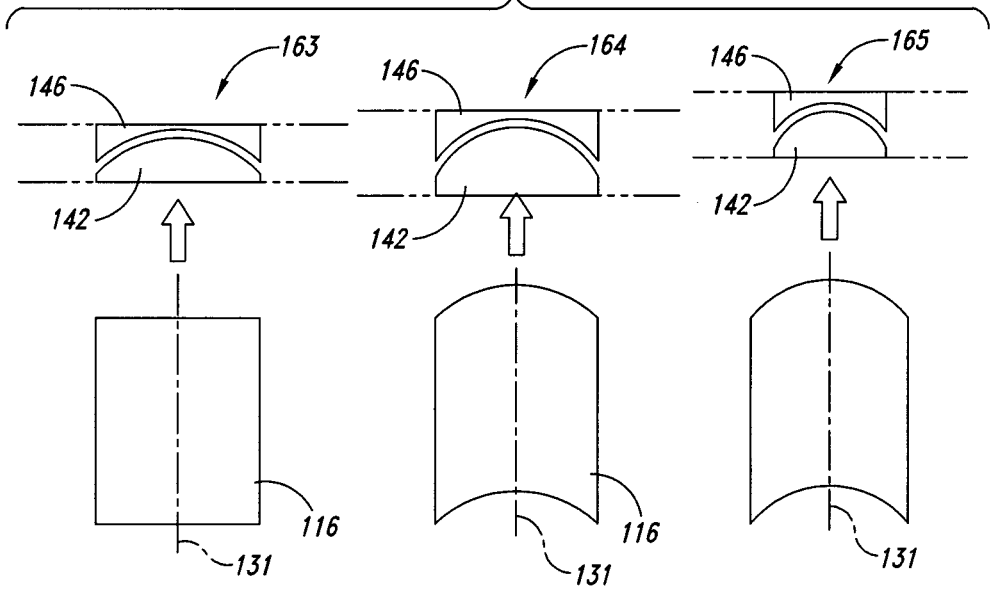

CONTOURED ROLLER SYSTEM AND ASSOCIATED METHODS AND RESULTING ARTICLES OF MANUFACTURE

CROSS-REFERENCE TO RELATED APPLICATION

The present application claims priority to U.S. Provisional Application 61/259,068, filed on Nov. 6, 2009 and incorporated herein by reference.

TECHNICAL FIELD

The present disclosure is directed generally to an article of manufacture and associated manufacturing methods and systems including contoured rollers used to form at least a partial hemisphere from a flat sheet of material.

BACKGROUND

Forming metal and other ductile materials into complex curved shapes with conventional methods is an expensive process. For example, forming curved shapes such as a hemispherical cap for a cylindrical, pressurized rocket fuel tank can be achieved by various conventional but expensive techniques. One such technique is spin forming in which material is placed over a mandrel, and the material and the mandrel are spun together on a lathe at high speeds. An external, local force can be applied to the material to form the material to the mandrel. Another technique is stretch forming in which a sheet of material is held at its edges and the center is pressed against a die to cause the sheet to take the shape of the die. Explosive forming is another conventional method that uses sudden, explosive pressure to cause a sheet of material to form to a die. Dish forming and head flanging operations are other methods used to form a cap or dome. While shapes such as a hemispherical shape may be produced in these ways, these techniques are difficult to perform, expensive, or yield inconsistent results.

FIGS. 1A and 1B show a conventional rolling technique involving three rollers 10, 11, and 12 used to form a material sheet 13 into a cylinder or partial cylinder. FIGS. 2A and 2B show a dish forming operation and a head flanging operation, respectively. The techniques shown in FIGS. 2A and 2B can be used to create compound curved shapes using a press 14 and a support 15. A material sheet 13 is held between the press 14 and the support 15. The shapes of the press 14 and support 15 give the sheet 13 a curved shape. A head flanging operation includes placing a material sheet 13 between a wheel 16 and die 17 to provide a sharper radius of curvature at the perimeter 18 of the sheet 13. FIG. 3 illustrates a system and technique for manufacturing semi-cylindrical sections using contoured roller pairs, each with a convex roller 20 and a concave roller 21. A material sheet 13 passes linearly through the rollers 20 and 21 to give the sheet 22 a U-shaped cross section. None of these techniques consistently produces compound curved sections (e.g., spherical sections) quickly and inexpensively.

BRIEF DESCRIPTION OF THE DRAWINGS

FIG. 6C is a partially schematic, cross-sectional view of a male roller and female rollers in accordance with embodiments of the present disclosure.

FIG. 6D is a partially schematic, cross-sectional view of a male and female roller pair in accordance with embodiments of the present disclosure.

DETAILED DESCRIPTION

Aspects of the present disclosure are directed generally to techniques for manufacturing members having a compound curvature (e.g., hemispherical members and sections of hemispherical members), and associated systems. Specific details of several embodiments of the disclosure are described below with reference to manufacturing a rocket fuel tank to provide a thorough understanding of these embodiments. In other embodiments, these techniques can be used to form other devices such as a radar dish, radome, or other doubly or compound curved sections. Several details describing structures or processes that are well-known and often associated with rolling and machining materials are not set forth in the following description for purposes of brevity. Moreover, although the following disclosure sets forth several embodiments of the invention, several other embodiments can have different configurations or different components than those described in this section. The dimensions shown in the Figures have been chosen to show certain aspects of the disclosure clearly, and may be exaggerated or otherwise altered for clarity and contrast and not necessarily to limit the scope of the present disclosure. Accordingly, other embodiments may include additional elements and/or may lack one or more of the elements described below with reference to FIGS. 4-7.

Figure 1A:
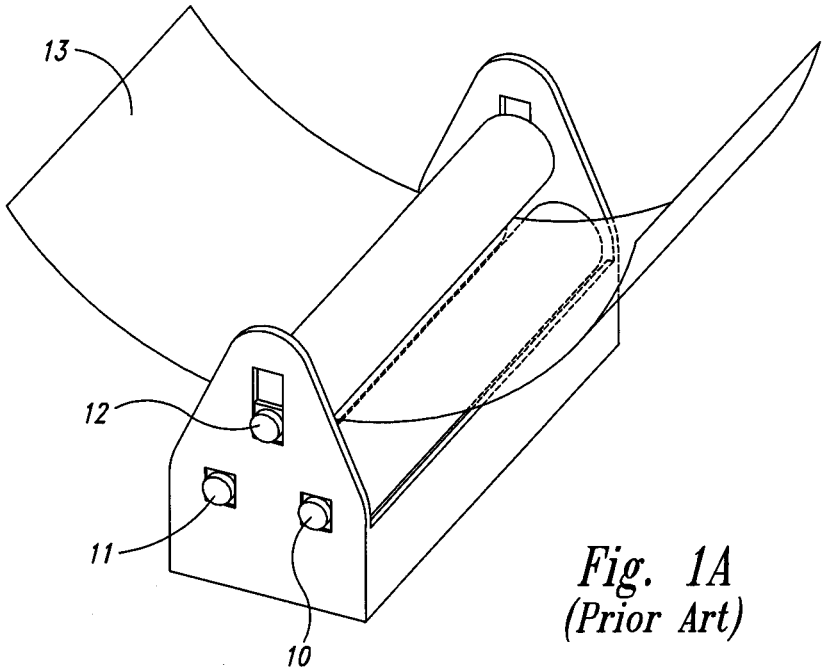
Fig. 1A (Prior Art)
FIGS. 1A and 1B are partially schematic views of conventional rolling apparatuses in accordance with the prior art.
Figure 1B:
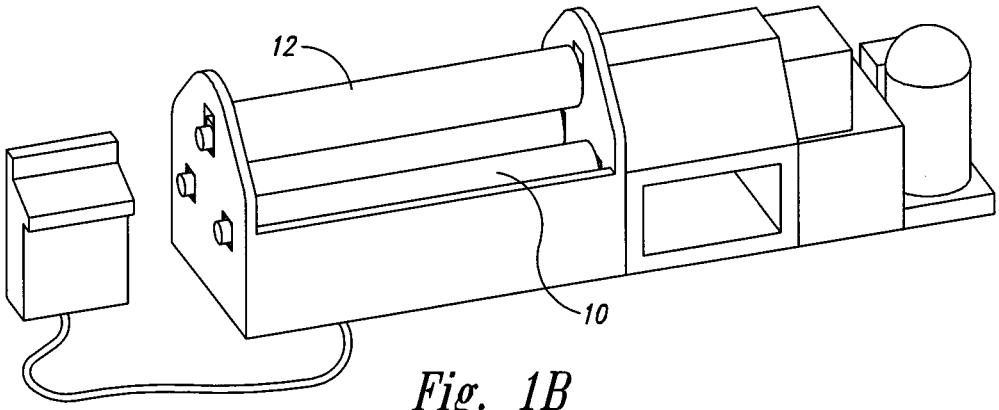
Fig. 1B (Prior Art)
Figure 2A:
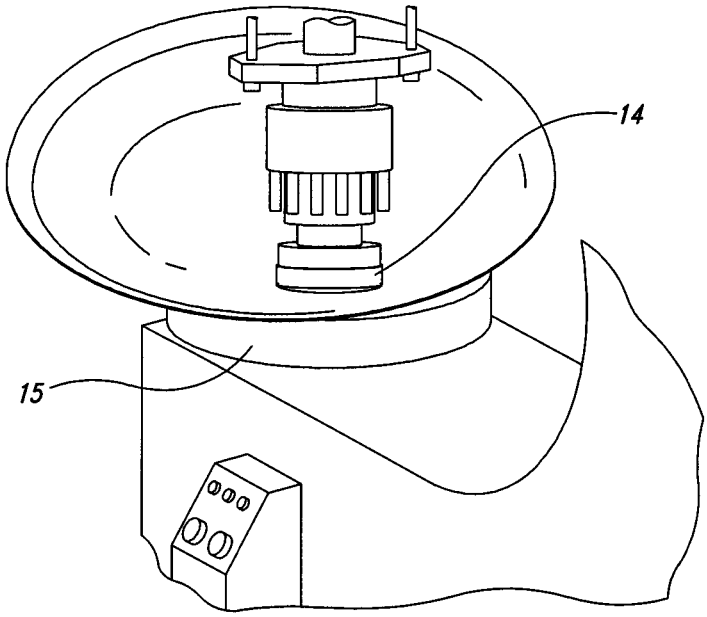
Fig. 2A (Prior Art)
FIG. 2A is an illustration of a dish forming tool and associated operation in accordance with the prior art.
Figure 2B:
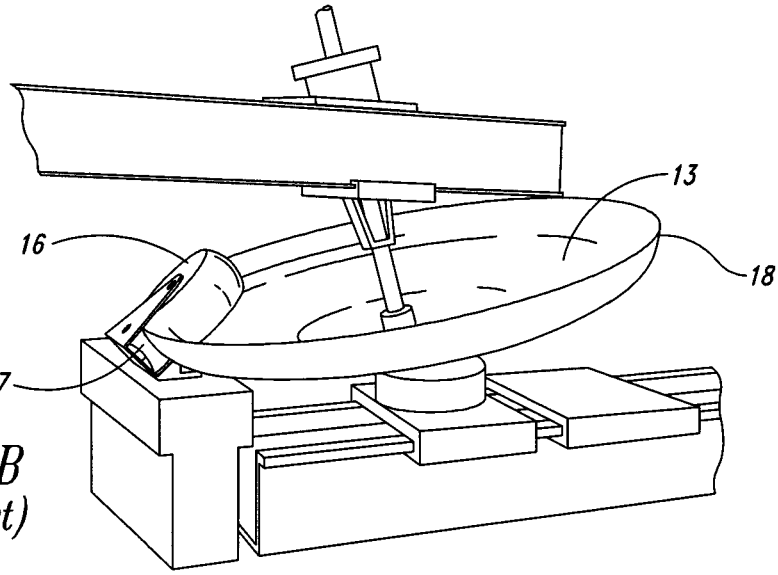
Fig. 2B (Prior Art)
FIG. 2B is an illustration of a head flanging tool and associated operation in accordance with the prior art.
Figure 3:
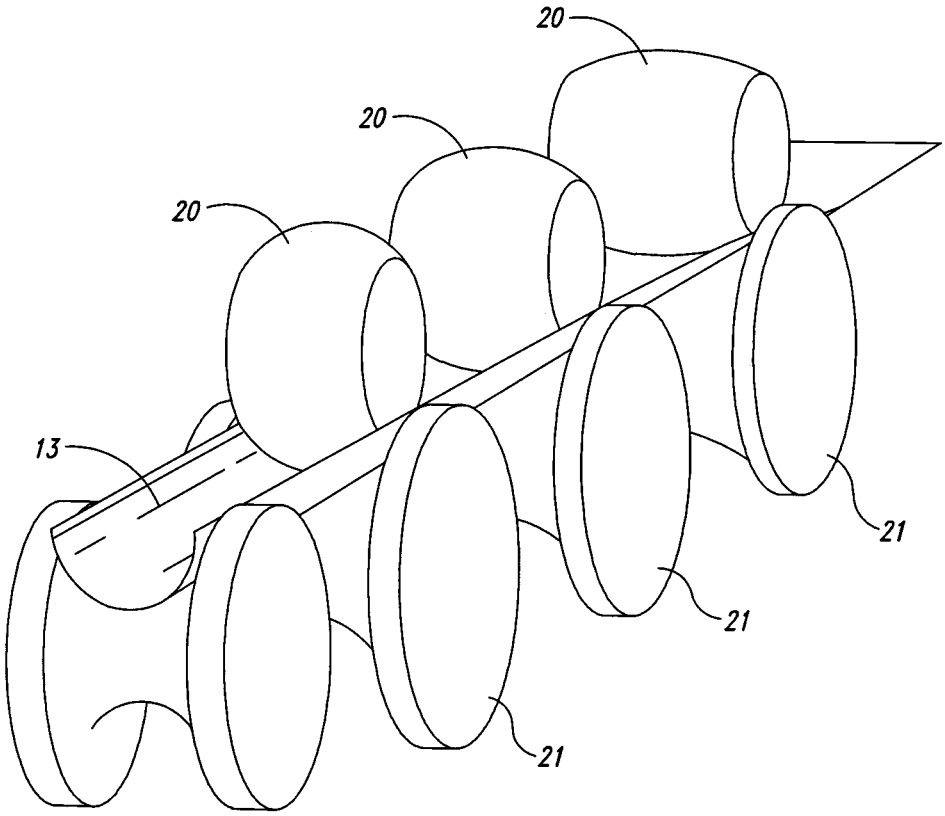
Fig. 3 (Prior Art)
FIG. 3 is a partially schematic illustration of a set of rollers for forming a member curved about a single axis in accordance with the prior art.
Figure 4:
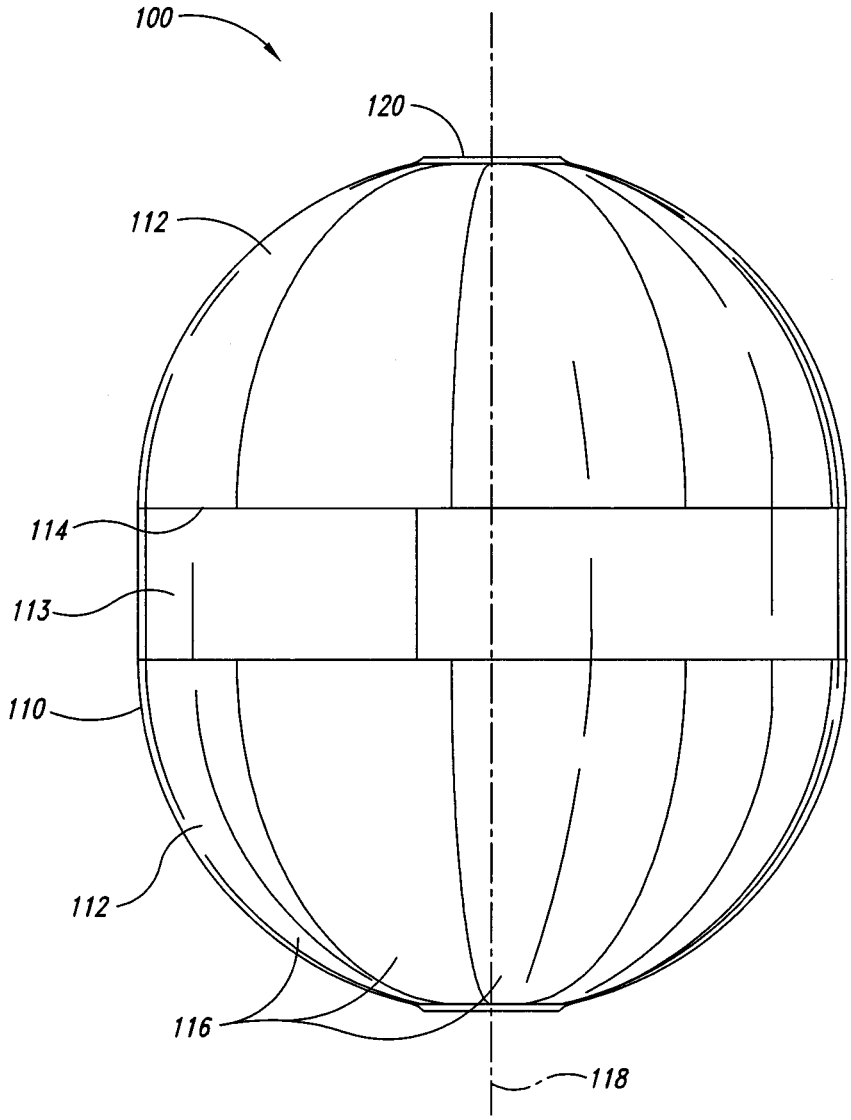
FIG. 4 is a partially schematic illustration of a fuel tank dome and associated components that can be manufactured using techniques in accordance with embodiments of the present disclosure.

FIG. 4 is a partially schematic, side view of a product 100 that can be constructed using techniques and devices described further below. In a particular aspect of this embodiment, the product 100 is a fuel tank 110, for example, a fuel tank suitable for liquid-fueled rockets. The fuel tank 110 can include a cylinder or cylindrical portion 113 connected to oppositely facing domes 112. The cylinder 113 can be formed from a rolled sheet that is welded at a cylinder weld 114. In some embodiments the domes 112 extend from the cylinder 113 tangentially; in other embodiments the domes 112 can be incomplete hemispheres such that the junctions between the cylinder 113 and the domes 112 are not tangential and continuous, but rather the junctions form an angled ridge around the base of the domes 112 where the domes 112 meet the cylinder 113. Each of the domes 112 can be formed from several sections 116 arranged around a central axis 118 and welded together. The sections 116 can be made from steel, aluminum, copper, bronze, brass, or another suitable ductile material. The sections 116 can be welded using friction stir welding techniques or other welding techniques. The sections 116 can extend to an apex 120 of the dome 112. In other embodiments, the sections 116 stop short of the apex 120 leaving a generally circular opening at the apex 120 of the dome. The opening can be circular or another shape, and can provide access to the tank 110 or can serve as a location for a pressure release valve or another utility depending on how the product 100 is used.

Figure 5A:
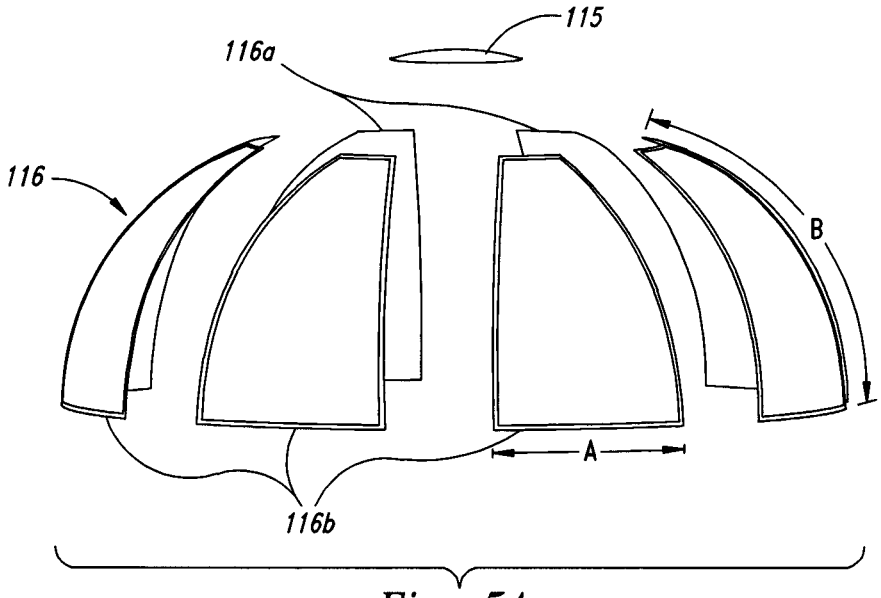
FIG. 5A is a partially schematic illustration of various dome structures and dome sections that can be manufactured using techniques in accordance with embodiments of the present disclosure.
Figure 5B:
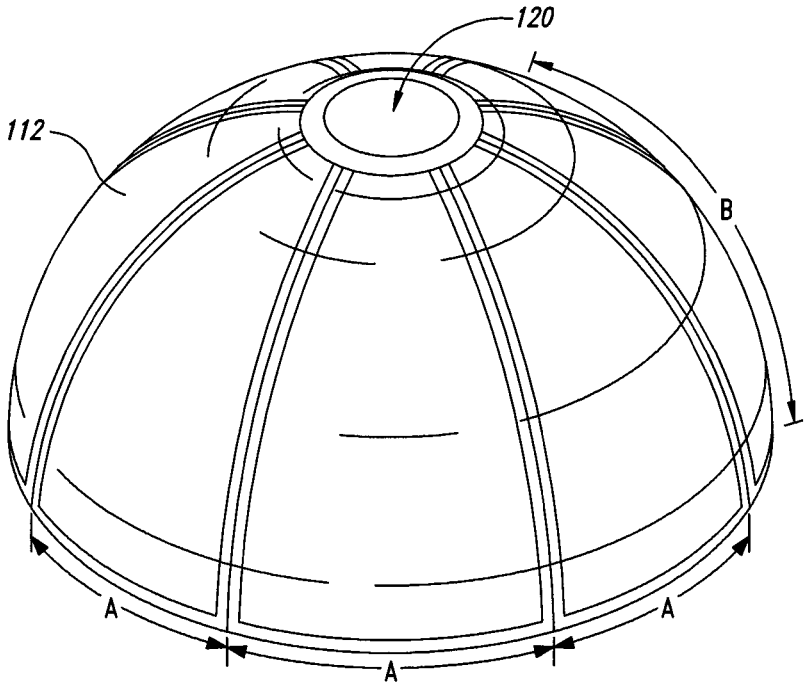
FIG. 5B is a partially schematic illustration of various dome structures and assembled dome sections that can be manufactured using techniques according to embodiments of the present disclosure.

FIG. 5 is a partially schematic illustration of several sections 116 and a flange 115 according to embodiments of the present disclosure. FIG. 5B is an isometric view of an assembled dome 112. FIG. 5 also includes an exploded view of a multiple sections 116 of the dome 112. The dome 112 is shown here with eight sections 116; however, in other embodiments the dome 112 can include other numbers and arrangements of sections 116, including a single section. The particular application of the product 100 will generally determine the number of sections 116 for any given dome 112. Generally speaking, domes 112 with more and smaller sections 116 are cheaper but are not as strong as a dome 112 with fewer, larger sections 116. In a particular embodiment, the sections 116 shown in FIGS. 5A and 5B generally have the same size and are distributed evenly around the dome 112. In other embodiments, however, the dome 112 can have sections 116 with different sizes, shapes, and/or arrangements. Each section 116 can have an apex 116*a* and a base 116*b* at least generally opposite the apex 116*a*. In any of these embodiments, each section can have a circumferential arc length A and an axial arc length B. The sum of the circumferential arc lengths of the sections can equal $2\pi$ radians for a complete circular perimeter. The sections 116 can have varying axial arc lengths as well. In some embodiments, the axial arc length B can be up to $\pi/2$ (90 degrees). In embodiments in which the apex 120 comprises a ring, or where the dome is less than a complete hemisphere, the arc length can be less than $\pi/2$. In some embodiments the dome 112 includes a flat or dish-shaped polar flange 115 positioned at the apex 120 of the dome 112. In these embodiments, the sections 116 can have a truncated apex 116*a*. In other embodiments the flange 115 may be a ring that surrounds an opening into the dome 112. In still further embodiments the flange 115 is absent, in which case the sections 116 can either extend to the apex 120 or they can reach only partially to the apex 120 leaving an opening at the apex 120. The flange 115 and the sections 116 can be welded together using known techniques.

Figure 6A:
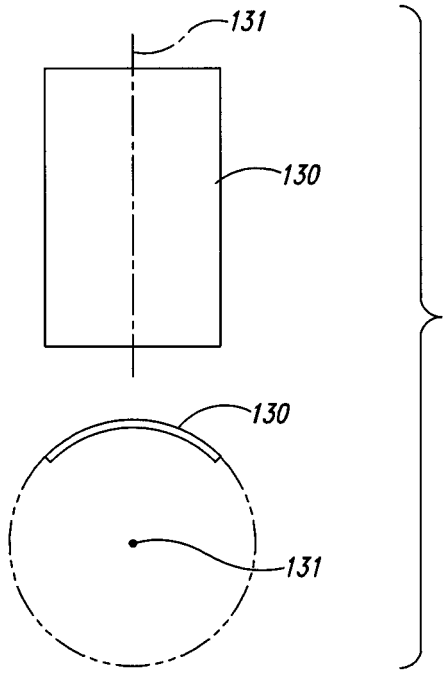
FIG. 6A is a partially schematic illustration of a singly-curved section that can be formed using techniques in accordance with embodiments of the present disclosure.

FIG. 6A depicts a member 130 that can be shaped into a section 116. In a particular embodiment, the member 130 begins as a generally flat, thin-walled, rectangular member. The member 130 can be shaped (e.g., with a standard roller) to have a curve about a first axis, for example, about a longitudinal axis 131.

Figure 6B:
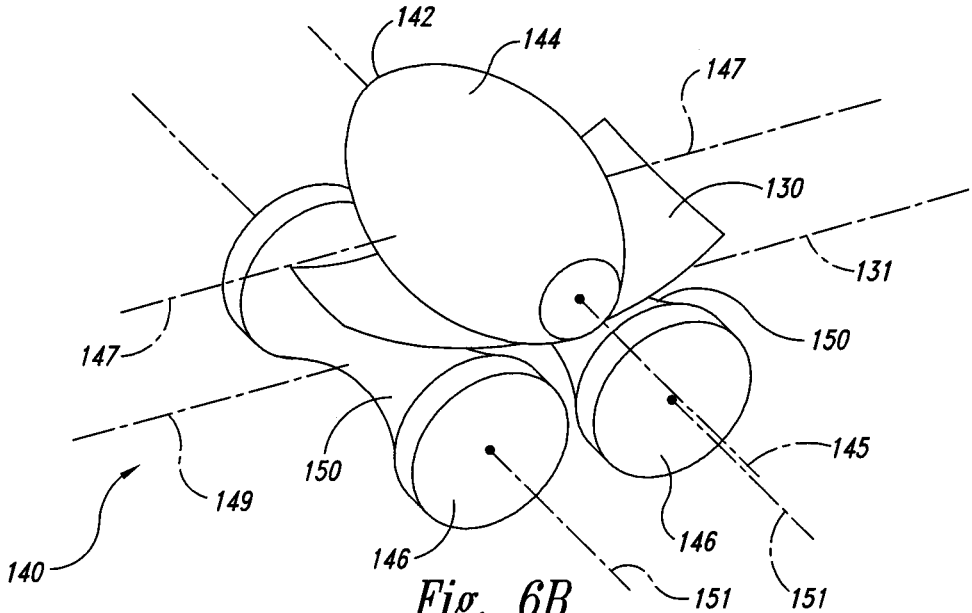
FIG. 6B is a partially schematic illustration of a male roller and a plurality of female rollers configured in accordance with embodiments of the present disclosure.

FIG. 6B shows a plurality of contoured rollers 140 that are used to provide a compound curvature to the member 130 in accordance with an embodiment of the present disclosure. The rollers 140 can include a male roller 142 having a convex surface 144 that is convex in two directions: it is convex about a longitudinal male roller axis 145, and about a transverse male roller axis 147. The rollers 140 also include two female rollers 146 that are convex in one direction (about a longitudinal female roller axis 151) and concave in another direction (about the transverse female roller axis 149). The foregoing axes are not necessarily located at the center of curvature of the corresponding curved surfaces 144, 150. The transverse roller axes 147, 149 can be orthogonal to corresponding longitudinal roller axes 145, 151. In one aspect of the disclosure, the rollers 140 are axisymmetric and can be constructed using a conventional lathe or other machine tool. The convex surface 144 can be have a uniform, circular radius, or can have another radius, for example, an elliptical radius. In any of the foregoing embodiments, the male roller 142 can be offset from and positioned between the neighboring female rollers 146, rather than being positioned directly opposite one of the female rollers 146.

In operation, the member 130 is curved about the longitudinal axis 131 before reaching the rollers 140 as described above with reference to FIG. 6A. The member 130 passes between the male roller 142 and the female rollers 146 with the longitudinal axis 131 being generally parallel with the transverse roller axes 147, 149. An upwardly facing surface of the member 130 can contact the male roller 142 and a downwardly facing, opposite surface of the member 130 can contact the female rollers 146. In selected embodiments, the convex surface 144 of the male roller 142 and the concave surface 150 of the female rollers 146 generally match the curvature of the incoming member 130. The position and orientation of the rollers 140 can impart a second curvature to the member 130 about the longitudinal male roller axis 145 and toward the male roller 142. In other words, the rollers 140 can receive the member 130 with a curve about a single axis (e.g., the longitudinal axis 131) and the rollers 140 can shape the member 130 with an additional curve about a second axis (e.g., the longitudinal male roller axis 145), resulting in a member 130 with a compound curvature. The member 130 can be trimmed to form an appropriately sized and shaped section 116 (FIG. 5).

In some embodiments the rollers 140 create the desired dual contour shape in the member 130 after one pass through the rollers; in other embodiments, more than one pass is needed before the member 130 takes the desired shape. The configuration of the rollers 140 can be adjusted for each successive pass through the rollers 140. For example, for each pass, the rollers 140 can be positioned to form a contoured shape with a different radius (e.g., tighter) than the previous pass. In some embodiments the relative position of the rollers 140 can be changed for each pass. In other embodiments, the member 130 can pass through a different set of rollers 140 for each pass. The rollers 140 can be configured to turn in one direction such that the member 130 passes through the rollers 140 without reversing direction. In still other embodiments the rollers 140 can reverse direction any number of times with the member 130 positioned between the rollers 140 and with the rollers changing position relative to each other to incrementally impart the desired shape to the member 130. In some embodiments a single male roller and a single female roller can be used to impart the doubly-curved shape to a thin member (e.g., approximately ⅛th of an inch thick or less). In such embodiments, the single male roller and the single female roller can be positioned directly opposite each other (e.g., one above the other), and the thin sheet can be inserted directly in between (e.g., in a horizontal direction).

In selected embodiments, the rollers 140 can be moved relative to each other while a member 130 is passing between them. The male roller 142 can be moved toward or away from the female rollers 146, and/or the female rollers 146 may be moved away from each other to alter the curvature imparted to the member 130. Alternatively, female rollers 146 can be positioned at different distances from the male roller such that a first female roller 146 is closer to the male roller 142, and a second female roller 146 is further from the male roller 146. In other embodiments, this arrangement can be reversed. Moving the rollers 140 while a member 130 is moving between the rollers 140 can form a compound curvature of non-uniform radius. For example, the rollers 140 can be positioned to give a first curvature to a leading edge of the member 130, and during the rolling operation the rollers can be moved to give a second curvature to the trailing edge of the member 130. The portion between the leading and trailing edge can have an intermediate curvature between the first and second curvature. The movement can be performed while the rollers 140 are rolling, or with the rollers 140 stopped. In subsequent passes through the rollers 140, the rollers 140 can be positioned to give a third curvature to a leading edge of the member 130 and a fourth curvature to the trailing edge of the member 130. Various combinations of the first, second, third, and fourth curvatures (or other suitable curvatures) can be used to reach a desired overall curvature which can be uniform or non-uniform.

FIG. 6C is a partially schematic, cross-sectional view of the rollers 140 with a member 130 passing between them. The cross-sectional view is representative of the relative positioning of the male roller 142 and the female rollers 146 at various points along the lengths of the rollers 140. Because this is a cross-sectional view, the convex and concave shapes of the surfaces of the rollers 140 outside the plane of the page are not apparent. As shown, the male roller 142 is positioned between the female rollers 146 such that passing the member 130 between the male roller 142 and the female rollers 146 urges the member 130 between the female rollers 146, causing the member 130 to curve toward the male roller 142. In other words, the member 130 is given a convex surface 117 facing the female rollers 146 and a concave surface 119 facing the male roller 142. After the procedure, the concave surface 119 of the member 130 can be concave in two directions: it can be concave about the longitudinal axis 131 and about a transverse axis 132 that extends out of the plane of FIG. 6C.

In selected embodiments, the longitudinal female roller axes 151 define a plane 160. The male roller 142 can have an apex 154 which is the closest point on the male roller 142 to the plane 160, and the female rollers 146 each have a corresponding apex 156 at the point farthest from the plane 160. The apex 154 on the male roller 142 can be nearer to the plane 160 than either of the apexes 156 on the female rollers 146. In some embodiments the radius of curvature of the dome 112 can be controlled by the distance 162 between the apex 154 and the plane 160, and also by the radius of the rollers 140.

The processes shown and described above may cause markings to appear on the surface of the section 116. The markings can be caused by the deformation of the material in the sheet, and may be in a pattern specific to the shape of the rollers 140. In some embodiments, these markings can be accentuated or minimized by other marks such as scribe lines or indentations placed into the surface of the section 116 either before or after passing through the rollers 140. The curvature and relative position of the rollers 140, as well as the number of roller sets, can also be chosen to accentuate or diminish the appearance of markings. It is expected that in at least some embodiments, the markings may be characteristic of the foregoing process.

FIG. 6D is a partially schematic view of a series of rollers including a first roller set 163, a second roller set 164, and a third roller set 165. Each roller set 163, 164, 165 can have two female rollers 146 and a male roller 142, but for purposes of illustration only one female roller 146 is shown in FIG. 6D. Several embodiments of the present disclosure can add curvature about the longitudinal axis 131 to an initially flat member 130. The member 130 begins as a flat, generally thin-walled member and passes through the first roller set 163, the second roller set 164, and the third roller set 165 consecutively. Each roller set imparts a different curvature to the member 130 until a final shape is achieved with a curvature about the longitudinal axis 131 and about the transverse axis 132. The number and incremental curvature of the roller sets 163, 164, 165 can vary depending on the material and dimensions of the member 130. For purposes of illustration the series of rollers 163, 164, 165 depicted has three sets of rollers, but other suitable numbers of roller sets can be used in other embodiments.

Figure 6E:
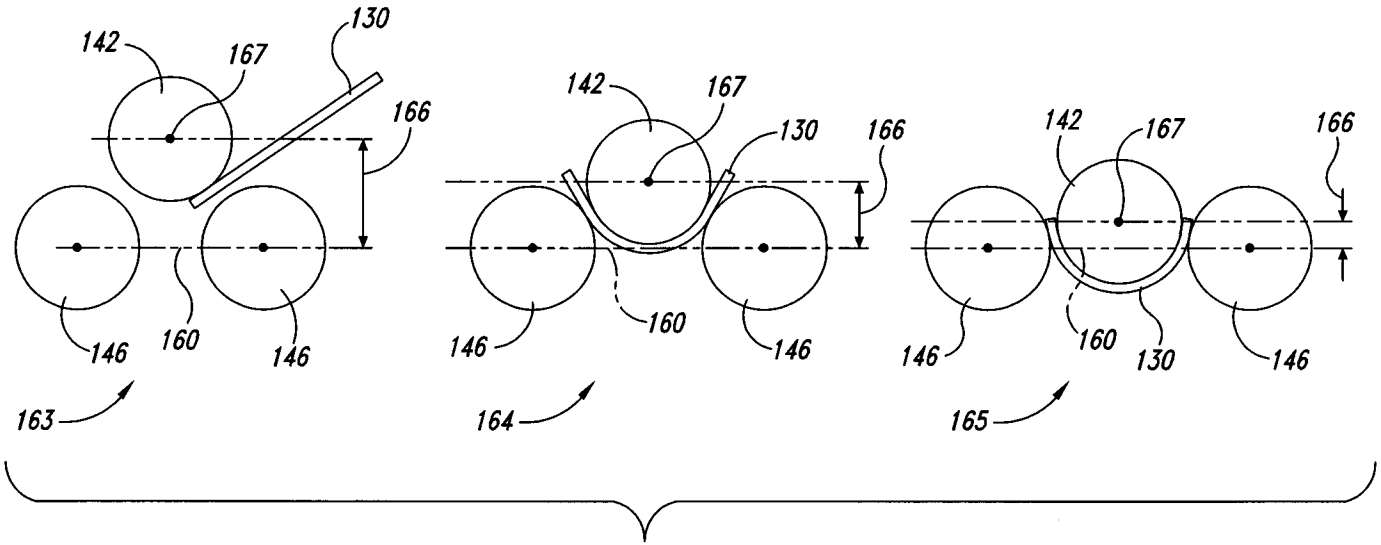
FIG. 6E is a partially schematic, cross-sectional view of a male roller and a pair of female rollers in accordance with embodiments of the present disclosure.

FIG. 6E shows an additional aspect of the roller sets 163, 164, and 165. In some embodiments, in each successive roller set, the male roller 142 is nearer to the female rollers 146. The distance 166 between the center 167 of the male roller 142 and the plane 160 is accordingly shorter for each successive roller set. For example, the distance 166 in roller set 165 is shorter than the distance 166 in roller set 164, which is in turn shorter than the distance 166 in roller set 163. As a member 130 passes through the roller sets, it is gradually curved toward the male roller 142. Some embodiments can include other suitable numbers of roller sets and other suitable distributions of curvatures. Also, in some embodiments a single set of rollers can be reconfigured and reused to incrementally add curvature to the member 130. For example, a batch of members 130 can pass through a roller set having a distance 166 between the male roller center 167 and the plane 160, after which the distance 166 can be reduced incrementally and the batch can pass through the roller set again. This process can be repeated with different incremental adjustments and iterations until the desired shape is achieved.

In some embodiments, a compound curved member 130 can be formed from an initially flat member 130 in a single series of roller sets 163, 164, 165. For example, the roller set 163 depicted in FIG. 6D can also have the characteristics of the roller set 163 depicted in FIG. 6E. Similarly, the other roller sets 164, 165 can have the characteristics shown in both FIGS. 6D and 6E. In selected embodiments, each roller set 163, 164, 165 can incrementally shape the member 130 about a longitudinal axis 131 and about the transverse axis 132. In some embodiments, the final shape of the member 130 can have approximately the same radius of curvature about the longitudinal axis 131 and about the transverse axis 132, resulting in a generally spherical shape.

Figure 7:
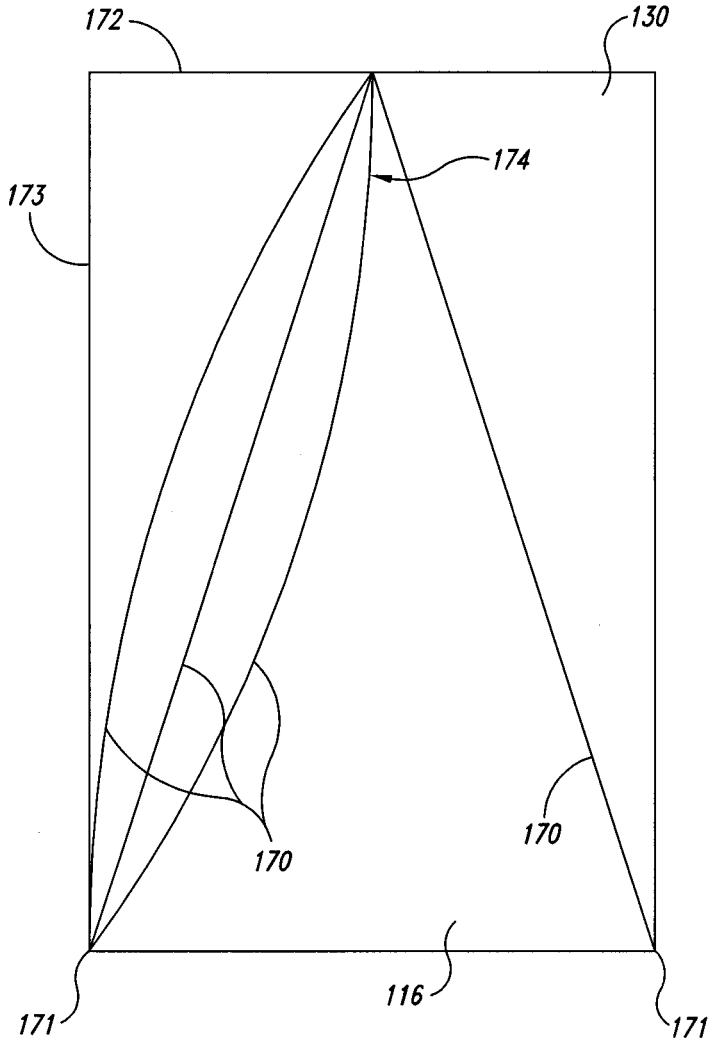
FIG. 7 is a partially schematic illustration of a section with trim lines in accordance with embodiments of the present disclosure.

FIG. 7 illustrates a partially schematic view of a member 130 with various trim lines 170 used to form corresponding sections 116. Depending on the shape of the dome 112 (or other hemispherical construction) for which the member 130 is formed, the member 130 can be trimmed before or after passing through the rollers. The member 130 can be trimmed into virtually any shape by suitable material cutting techniques. The trimmed edge can be straight, convex, or concave. In selected embodiments, the trim line 170 is a straight line that extends from the bottom corner 171 and intersects a top edge 172 of the member 130 at any point along the top edge 172. For a dome 112 that will have a polar flange 115 (either a complete flange or a ring flange), the trim lines 170 can intersect the top edge closer to the side edge 173 leaving a portion of the top edge 172 that will form the edge of the opening in the dome 112. To construct a hemispherical assembly in which the sections 116 are to extend to the apex of the assembly, the trim lines 170 can intersect in the middle of the top edge 172 or at some point 174 below the top edge 172 such that the section 116 comes to a point after trimming. The trim lines 170 can be marked on the member 130 at any point before trimming the section 116 from the member 130. For example, the trim lines 170 can be marked on the member 130 while the member 130 is a flat sheet, while the member 130 has a single curvature (partially cylindrical shape, or U-shaped cross section), or after passing through the rollers 140 to receive a compound curvature.

From the foregoing, it will be appreciated that specific embodiments of the disclosure have been described herein for purposes of illustration, but that various modifications may be made without deviating from the disclosure. For example, while the foregoing embodiments were described generally in the context of a fuel tank, the foregoing techniques and systems may be used to form structures other than fuel tanks. The foregoing structures and methods were described in the context of rolling metal sheets, but may also be applicable to forming other materials.

Certain aspects of the embodiments described above may be combined or eliminated in other embodiments. While advantages associated with certain embodiments have been described in the context of those embodiments, other embodiments may also exhibit such advantages, and not all embodiments need necessarily exhibit such advantages to fall in the scope of the present disclosure. Accordingly, the disclosure can include other embodiments not expressly shown or described above.

I claim:

1. A method for producing a doubly curved shape, comprising:

receiving a member comprising a generally thin sheet of material, the member having a first side and a second side opposite the first side;

bending the member about a first axis to form a concave member surface on the first side and a convex member surface on the second side;

receiving the member between a male roller and a pair of female rollers with the male roller contacting the first side and having a convex roller surface that generally matches the concave member surface, and with the pair of female rollers contacting the second side and having corresponding concave roller surfaces that generally match the convex member surface;

imparting a doubly curved shape to the member by rotating the male roller and the pair of female rollers to bend the member about a second axis transverse to the first axis, the member having an axial arc length of less than approximately 90 degrees, the member further having an apex and a base opposite the apex; and joining the member with at least one other member having an apex, the apexes of the members forming a closed dome segment.

2. The method of claim 1 wherein the male roller is convex about a longitudinal roller axis and convex about a transverse roller axis, and wherein imparting the doubly curved shape comprises rotating the male roller with the convex roller surface contacting the first side of the member, and wherein rotating the male roller comprises rotating the male roller about the longitudinal axis.

3. The method of claim 1 wherein the female rollers each are convex about a longitudinal axis and are each concave about a corresponding transverse roller axis, and wherein imparting the doubly curved shape comprises rotating the female rollers with the concave roller surface contacting the second side of the member, and wherein rotating the female rollers comprises rotating the female rollers about the corresponding longitudinal roller axes.

4. The method of claim 1 wherein receiving the member between the male roller and the pair of female rollers comprises receiving the member between a first male roller and a first pair of female rollers, and wherein the doubly curved shape has a first radius, and wherein the method further comprises:

receiving the member between a second male roller and a second pair of female rollers with the second male roller contacting the first side and having a convex roller surface that generally matches the concave member surface, and with the second pair of female rollers contacting the second side and having a concave roller surface that generally matches the convex member surface; and rotating the second male roller and the pair of female rollers to further bend the member about a third axis transverse to the first axis such that the member has a second doubly curved shape, the second doubly curved shape having a smaller radius than the first doubly curved shape.

5. The method of claim 1 wherein the male roller and female rollers form a first roller set, the first roller set being one of a series of roller sets and wherein the method further comprises:

sequentially receiving the member between the male roller and female rollers of each roller set; and rotating the male rollers and the female rollers to bend the member about the second axis, wherein the male roller and corresponding female roller of each successive set has a smaller radius than a corresponding radius of the immediately preceding set in the series.

6. A method for producing a doubly curved shape, comprising:

receiving a member comprising a generally thin sheet of material, the member having a first side and a second side opposite the first side;

bending the member about a first axis to form a concave member surface on the first side and a convex member surface on the second side;

receiving the member between a male roller and a pair of female rollers with the male roller contacting the first side and having a convex roller surface that generally matches the concave member surface, and with the pair of female rollers contacting the second side and having corresponding concave roller surfaces that generally match the convex member surface;

imparting a doubly curved shape to the member by rotating the male roller and the pair of female rollers to bend the member about a second axis transverse to the first axis, the member having an axial arc length of less than approximately 90 degrees, the member further having a truncated apex and a base opposite the truncated apex; and joining the member with at least one other member having a truncated apex, with the members forming a partial dome and further with the truncated apexes of the members forming a ring at an end of the partial dome.

7. A method for producing a doubly curved shape, comprising:

receiving a member comprising a generally thin sheet of material, the member having a first side and a second side opposite the first side;

bending the member about a first axis to form a concave member surface on the first side and a convex member surface on the second side;

receiving the member between a male roller and a pair of female rollers with the male roller contacting the first side and having a convex roller surface that generally matches the concave member surface, and with the pair of female rollers contacting the second side and having corresponding concave roller surfaces that generally match the convex member surface;

imparting a doubly curved shape to the member by rotating the male roller and the pair of female rollers to bend the member about a second axis transverse to the first axis, the member having an axial arc length of less than approximately 90 degrees, the member further having an apex and a base;

joining the member with at least one other doubly curved member to form a partial hemisphere; and joining the partial hemisphere with a cylinder.

8. The method of claim 7 wherein an intersection between the cylinder and the member is tangential.

9. A method for manufacturing a member with a doubly curved shape, comprising:

receiving a member comprising a generally thin sheet of material, the member having a first side and a second side opposite the first side;

bending the member about a first axis to form a concave member surface on the first side and a convex member surface on the second side;

receiving the member between a first male roller and a first pair of female rollers with the first male roller contacting the first side and having a convex roller surface that generally matches the concave member surface, and with the first pair of female rollers contacting the second side and having corresponding concave roller surfaces that generally match the convex member surface;

imparting a doubly curved shape to the member by rotating the male roller and the pair of female rollers to bend the member about a second axis transverse to the first axis, the doubly curved shape having a first radius;

receiving the member between a second male roller and a second pair of female rollers with the second male roller contacting the first side and having a convex roller surface that generally matches the concave member surface, and with the second pair of female rollers contacting the second side and having a concave roller surface that generally matches the convex member surface; and rotating the second male roller and the pair of female rollers to further bend the member about a third axis transverse to the first axis such that the member has a second doubly curved shape, the second doubly curved shape having a smaller radius than the first doubly curved shape.

10. A method for manufacturing a member with a doubly curved shape, comprising:

receiving a member comprising a generally thin sheet of material, the member having a first side and a second side opposite the first side;

bending the member about a first axis to form a concave member surface on the first side and a convex member surface on the second side;

receiving the member between a male roller and a pair of female rollers with the male roller contacting the first side and having a convex roller surface that generally matches the concave member surface, and with the pair of female rollers contacting the second side and having corresponding concave roller surfaces that generally match the convex member surface, wherein the male roller and female roller form a first roller set, the first roller set being one of a series of roller sets;

imparting a doubly curved shape to the member by rotating the male roller and the pair of female rollers to bend the member about a second axis transverse to the first axis;

sequentially receiving the member between the male roller and female rollers of each roller set; and rotating the male rollers and the female rollers to bend the member about the second axis, wherein the male roller and corresponding female roller of each successive set has a smaller radius than a corresponding radius of the immediately preceding set in the series.

* * * * *